US007364774B2

(12) United States Patent
Urscheler et al.

(10) Patent No.: US 7,364,774 B2
(45) Date of Patent: Apr. 29, 2008

(54) METHOD OF PRODUCING A MULTILAYER COATED SUBSTRATE HAVING IMPROVED BARRIER PROPERTIES

(75) Inventors: Robert Urscheler, Horgen (CH); Francis Dobler, Binz (CH)

(73) Assignee: Dow Global Technologies Inc., Midland, MI (US)

( * ) Notice: Subject to any disclaimer, the term of this patent is extended or adjusted under 35 U.S.C. 154(b) by 0 days.

(21) Appl. No.: 10/687,324

(22) Filed: Oct. 16, 2003

(65) Prior Publication Data

US 2004/0121079 A1 Jun. 24, 2004

Related U.S. Application Data

(63) Continuation-in-part of application No. 10/273,922, filed on Oct. 17, 2002, now abandoned, which is a continuation-in-part of application No. 10/257,172, filed as application No. PCT/US02/12002 on Apr. 12, 2002.

(51) Int. Cl.
*B05D 1/30* (2006.01)

(52) U.S. Cl. ..... 427/420; 427/402; 427/411

(58) Field of Classification Search ..... 427/420, 427/402, 407.1, 411, 419.1, 419.2, 419.3, 427/419.5, 419.7, 419.8
See application file for complete search history.

(56) References Cited

U.S. PATENT DOCUMENTS

| | | | | |
|---|---|---|---|---|
| 2,761,419 A | | 9/1956 | Mercier et al. | |
| 3,005,440 A | | 10/1961 | Padday | |
| 3,419,203 A | | 12/1968 | Amend, Jr. | |
| 3,436,022 A | | 4/1969 | Ernst | 239/455 |
| 3,508,947 A | * | 4/1970 | Hughes | 430/538 |
| 3,632,374 A | | 1/1972 | Greiller | |
| 4,001,024 A | * | 1/1977 | Dittman et al. | 430/531 |
| 4,041,897 A | | 8/1977 | Ade | 118/300 |
| 4,109,611 A | | 8/1978 | Fahrni et al. | 118/325 |
| 4,230,743 A | | 10/1980 | Nakamura | |
| 4,358,476 A | | 11/1982 | Zimmer et al. | 427/44 |
| 4,569,863 A | | 2/1986 | Koepke et al. | |
| 4,975,304 A | | 12/1990 | Kawahara et al. | |
| 5,118,533 A | | 6/1992 | Saji et al. | |
| 5,224,996 A | | 7/1993 | Ghys et al. | |
| 5,234,500 A | | 8/1993 | Korokeyi | |
| 5,236,744 A | | 8/1993 | Suga et al. | |
| 5,238,534 A | | 8/1993 | Manning et al. | |
| 5,270,355 A | | 12/1993 | Kawano et al. | |
| 5,290,672 A | | 3/1994 | Dunk | |

(Continued)

FOREIGN PATENT DOCUMENTS

BE 852751 9/1977

(Continued)

OTHER PUBLICATIONS

Derwent abstract of DD 221722 (published May 2, 1985).*

(Continued)

*Primary Examiner*—Katherine Bareford

(57) ABSTRACT

The present invention refers to a method of producing a coated substrate comprising the steps of:
a) forming a composite, multilayer free flowing curtain, whereby the multilayer free flowing curtain comprises at least two layers imparting at least two different barrier functionalities and
b) contacting the curtain with a continuous web substrate.

30 Claims, 1 Drawing Sheet

U.S. PATENT DOCUMENTS

| | | | | |
|---|---|---|---|---|
| 5,391,401 | A | 2/1995 | Blake et al. | 427/420 |
| 5,393,571 | A | 2/1995 | Suga et al. | |
| 5,447,753 | A | 9/1995 | Noda et al. | |
| 5,505,995 | A | 4/1996 | Leonard | |
| 5,506,000 | A | 4/1996 | Leonard | |
| 5,641,544 | A | 6/1997 | Melancon | |
| 5,643,992 | A | 7/1997 | Northey | 524/501 |
| 5,654,039 | A | 8/1997 | Wenzel et al. | |
| 5,733,608 | A | 3/1998 | Kessel et al. | 427/547 |
| 5,773,093 | A | 6/1998 | Mitani | |
| 5,789,031 | A | 8/1998 | Hirabayashi et al. | |
| 5,861,195 | A | 1/1999 | Bhave et al. | |
| 5,876,815 | A | 3/1999 | Sandstrom | |
| 5,885,659 | A | 3/1999 | Takahashi et al. | |
| 6,060,206 | A | 5/2000 | Hanaki et al. | |
| 6,086,954 | A | 7/2000 | Kaufmann | |
| 6,099,913 | A | 8/2000 | Clarke et al. | 427/420 |
| 6,103,313 | A | 8/2000 | Clarke et al. | 427/420 |
| 6,106,902 | A | 8/2000 | Koskinen et al. | |
| 6,120,784 | A | 9/2000 | Snyder, Jr. | |
| 6,146,690 | A | 11/2000 | Kustermann | |
| 6,214,416 | B1 | 4/2001 | Sakagami | |
| 6,294,023 | B1 | 9/2001 | Katagiri et al. | |
| 6,335,085 | B1 | 1/2002 | Asano et al. | |
| 6,358,306 | B1 | 3/2002 | Hanada et al. | |
| 6,419,987 | B1 | 7/2002 | Bauer et al. | |
| 6,458,413 | B1 | 10/2002 | Hirabayashi et al. | |
| 6,479,107 | B2 | 11/2002 | Katagiri et al. | |
| 6,497,926 | B1 * | 12/2002 | Yokota et al. | 427/542 |
| 6,982,003 | B2 | 1/2003 | Gueggi et al. | |
| 6,548,120 | B1 * | 4/2003 | Wittosch et al. | 427/411 |
| 6,558,740 | B1 | 5/2003 | Santo et al. | |
| 6,562,441 | B1 | 5/2003 | Maeda et al. | 428/195 |
| 6,579,569 | B2 | 6/2003 | Bermel et al. | |
| 6,746,718 | B2 | 6/2004 | Yokota | |
| 6,780,455 | B2 | 8/2004 | Clarke et al. | |
| 7,172,793 | B2 | 2/2007 | Cohu | |
| 7,208,068 | B2 | 4/2007 | Nisogi et al. | |
| 2001/0008653 | A1 | 7/2001 | Katagiri et al. | |
| 2001/0016231 | A1 | 8/2001 | Bower | 427/420 |
| 2002/0009549 | A1 | 1/2002 | Ogawa | |
| 2002/0066404 | A1 | 6/2002 | Ueberschar et al. | 118/261 |
| 2002/0160121 | A1 * | 10/2002 | Katagiri et al. | 427/420 |
| 2003/0003197 | A1 | 1/2003 | Berlin et al. | 426/106 |
| 2003/0064162 | A1 | 4/2003 | Clarke et al. | |
| 2003/0118739 | A1 | 6/2003 | Li et al. | 427/421 |
| 2003/0149115 | A1 | 8/2003 | Garces et al. | |
| 2003/0180470 | A1 | 9/2003 | Oki et al. | |
| 2003/0188839 | A1 | 10/2003 | Urscheler | |
| 2003/0190432 | A1 | 10/2003 | Yokota et al. | 427/420 |
| 2003/0194501 | A1 | 10/2003 | Urscheler et al. | |
| 2003/0235657 | A1 | 12/2003 | Schweizer et al. | 427/420 |
| 2004/0013815 | A1 | 1/2004 | Gros | |
| 2004/0052953 | A1 | 3/2004 | Cohu | |
| 2004/0121079 | A1 | 6/2004 | Urscheler et al. | |
| 2004/0121080 | A1 | 6/2004 | Urscheler et al. | |
| 2004/0253385 | A1 | 12/2004 | Gueggi | |
| 2004/0265496 | A1 | 12/2004 | Gueggi et al. | |
| 2005/0039871 | A1 | 2/2005 | Urscheler et al. | |
| 2006/0005933 | A1 | 1/2006 | Okomori et al. | |
| 2006/0051528 | A1 | 3/2006 | Ogino et al. | |

FOREIGN PATENT DOCUMENTS

| | | | |
|---|---|---|---|
| EP | 0919395 | | 6/1999 |
| EP | 1249533 | | 10/2002 |
| GB | 838392 | | 6/1960 |
| JP | 03-222221 | B | 10/1991 |
| JP | 03-222293 | B | 10/1991 |
| JP | 05-106198 | A | 4/1993 |
| JP | 1993117996 | | 5/1993 |
| JP | 05-247890 | A | 9/1993 |
| JP | 06-346400 | A | 12/1994 |
| JP | 07-300796 | A | 11/1995 |
| JP | 08-310110 | | 11/1996 |
| JP | 11-192777 | | 5/1998 |
| JP | 2000-45200 | | 7/1998 |
| JP | 10-328613 | | 12/1998 |
| JP | 11192777 | | 7/1999 |
| JP | 2000-045200 | * | 2/2000 |
| JP | 2000-070810 | * | 3/2000 |
| JP | 2000-153214 | A | 6/2000 |
| JP | 2001-300386 | | 10/2001 |
| WO | 92/11095 | * | 7/1992 |
| WO | WO 98/45054 | | 10/1998 |
| WO | WO 01/54828 | | 2/2001 |
| WO | WO 02/053838 | | 7/2002 |
| WO | WO 02/066739 | | 8/2002 |
| WO | WO 02/081576 | | 10/2002 |
| WO | WO 02/084029 | | 10/2002 |
| WO | WO 2004/035931 | | 4/2004 |
| WO | WO 2004/101691 | A2 | 11/2004 |
| WO | WO 2006/070065 | A1 | 7/2006 |

OTHER PUBLICATIONS

Schwelzer, Peter M."Premetered coating processes, Advantages and applications", *Coating*, 1998.

Alleborn, Norbert et al., "High-speed curtain coating of paper", *PTS-Coating Symposium*, 2001.

Miyamoto, K. and Yoshinobu Katagiri, "Curtain Coating", *Liquid Film Coating*, 1997, 463-494.

Triantafillopoulos, Nick et al., "Operational Issues in High-speed Curtain Coating of Paper", 2001.

Derwent Abstract 1992-429056, Japanese Patent 04-325586, Wakata Kazuyoshi et al., Nov. 13, 1992.

Derwent Abstract 1992-429948, Japanese Patent 04-327296, Higuchi Masahiro et al., Nov. 16, 1992.

Derwent Abstract 1995-196793, Japanese Patent 07-113068, Moroishi Yutaka et al., May 2, 1995.

Derwent Abstract 1999-063934, Japanese Patent 10-309506, Kashiwada Hirotaka et al., Nov. 24, 1998.

Derwent Abstract 1992-170429, Japanese Patent 04100998, Apr. 2, 1992.

Derwent Abstract 1993-055029, Japanese Patent 05004441, Sugiyama Takeo, Jan. 14, 1993.

Derwent Abstract 1994-222740, Japanese Patent 6158591, Jun. 7, 1994.

Derwent Abstract 1995-009867, Japanese Patent 6294099, Arai Takao et al., Oct. 21, 1994.

Derwent Abstract 1995-204515, Japanese Patent 07119083, May 9, 1995.

Derwent Abstract 2001-274380, Japanese Patent 2001/018526, Jul. 7, 1999.

Derwent Abstract 2001-239141, Japanese Patent 2001/038284, Yanagisawa Kenji et al., Jul. 30, 1999.

Derwent Abstract 2001-274380, Japanese Patent 2001/138631, Maruyama et al., May 22, 2001.

Derwent Abstract 2001-003151, Japanese Patent 2001/252612, Sunakawa Tomohide, Sep. 18, 2001.

Derwent Abstract 2002-044693, Japanese Patent 2001/262499, Yamane Kengo, Sep. 26, 2001.

Derwent Abstract 2002-296627, Japanese Patent 2001/293956, Shiraishi et al., Oct. 23, 2001.

Derwent Abstract 2003-357679, Japanese Patent 2002/307804, Yokota Yasuro, Oct. 23, 2002.

Derwent Abstract 2003-516007, Japanese Patent 2002/323734, Nagahama Masaru et al., Nov. 8, 2002.

Derwent Abstract 2000-642699, Japanese Patent 2000/262962, Ishiguro Naoyuki, Sep. 26, 2000.

Derwent Abstract 2002-041276, International Patent 200176884, Shiraishi et al., Oct. 18, 2001.

MicroPatent Abstract: WO9847630A1; Meier, et al., Oct. 29, 1998.

Stephan F. Kistler and Peter M. Schweizer; *Liquid Film Coating Scientific Principles and Their Technological Implications*; Chapman & Hall; New York; 1997; Chapter 11; "Slot Coating"; pp. 401-536.

Stephan F. Kistler and Peter M. Schweizer; *Liquid Film Coating Scientific Principles and Their Technological Implications*; Chapmen & Hall; New York; 1997; Chapter 15; "Control and Optimization of Coating Processes"; pp. 735-768.

Triantafillopoulos, Nick, et al., "Operational Issues In High-Speed Curtain Coating of Paper," 2001 TAPPI Coating and Graphic Arts Conference and Trade Fair (May 6-9, 2001), pp. 251-263, San Diego, CA, USA.

Schweizer, Peter M., "Simultaneous Multilayer Coating Technologies: Attractiveness and Limitations," TAPPI Coating Conference 2002, (May 5-8, 2002), pp. 1-14, Orlando, FL, USA.

Urscheler, Robert, et al., "Key Attributes and Opportunities of Multilayer Curtain Coating for Paper," 2005 TAPPI Coating Conference and Exhibit, (Apr. 17-20, 2005) pp. 1-16 (including 23 pgs of slides).

Alleborn, Norbert, et al., "Anwendung der Vorhangbeschichtung zur Oberflachenveredelung von Bauelementen aus Beton," *Chemie Ingenieur Technik*, 77, No. 1-2 (2005), , pp. 84-89.

D. Meck, et al., "Non-Impact coating in the curtain coater", 20. Streicherel-Symposium 2001, p. 34-1 to 34-6, German language with English language abstract.

* cited by examiner

METHOD OF PRODUCING A MULTILAYER COATED SUBSTRATE HAVING IMPROVED BARRIER PROPERTIES

Cross Reference to Related Applications

This application is a continuation-in-part of U.S. application Ser. No. 10/273,922, filed Oct. 17, 2002, now abandoned, which is a continuation-in-part of U.S. application Ser. No. 10/257,172, filed Apr. 17, 2003, which is a national stage application of PCT/US02/12002, filed Apr. 12, 2002.

BACKGROUND OF THE INVENTION

The present invention relates to a method of producing a coated substrate having barrier properties.

Substrates having barrier properties are of great importance for packaging food, beverage, or other products that are sensitive to environmental influences. Those substrates generally are provided with a barrier layer using well-known coating techniques such as blade coating, bar (rod) coating, reverse roll (film) coating, or air knife coating. However, each of these application methods has its own set of problems that can result in inferior barrier quality. Furthermore, a common feature of all these methods is that the amount of coating liquid applied to a paper web, which generally has an irregular surface with hills and valleys, is different depending on whether it is applied to a hill or a valley. Therefore, the coating thickness and thus the barrier properties will vary across the surface of the coated substrate resulting in barrier irregularities. Moreover, said methods are also limited in how thin a coating layer may be applied to the substrate. Another drawback of said coating methods known in the prior art that at each coating station only a single layer can be applied to the substrate. If several barrier layers are to be applied to a substrate, then each of said coating layers needs a separate coating station or subsequent coating in a further coating machine. This sequential approach to making multilayer coatings is undesirable in that the subsequent coating steps of the prior art fail when attempting to apply an additional layer to a layer that is very hydrophobic and water repellent. Despite their drawbacks, these coating methods are still the dominant processes in the paper industry due to their economics, especially since very high line speeds can be achieved.

Curtain coating is a relatively new coating technique. EP-A 517 223: and Japanese patent applications JP-94-89437, JP-93-311931, JP-93-177816, JP-93-131718, JP-92-298683, JP-92-51933, JP-91-298229, JP-90-217327, and JP-8-310110 disclose the use of curtain coating methods to apply one or more pigmented coating layers to a moving paper surface.

More specifically, the prior art relates to:

(i) The curtain coating method being used to apply a single layer of pigmented coating to a basepaper substrate to produce a single-layer-pigmented coating on paper.

(ii) The curtain coating method being used to apply a single priming layer of pigmented coating to a basepaper substrate prior to the application of a single layer of pigmented topcoat applied by a blade type coating process. Thus a multilayer-pigmented coating of paper was achieved by sequential applications of pigmented coating.

(iii) The curtain coating method being used to apply a single topcoating layer of pigmented coating to a basepaper substrate that has previously been primed with a single layer of pigmented precoat that was applied by a blade or a metering roll type coating process. Thus a multilayer-pigmented paper coating was achieved by sequential applications of pigmented coating.

(iv) The curtain coating method being used to apply two single layers of specialized pigmented coating to a basepaper substrate such that the single layers were applied in consecutive processes. Thus a multilayer-pigmented coating of paper was achieved by sequential applications of pigmented coating.

The use of a curtain coating method to apply a single layer of pigmented coating to the surface of a moving web of paper, as disclosed in the prior art discussed above, is stated to offer the opportunity to produce a superior quality coated paper surface compared to that produced by conventional coating means. However, the sequential application of single layers of pigmented coating using curtain coating techniques is constrained by the dynamics of the curtain coating process. Specifically, lightweight coating applications can only be made at coating speeds below those currently employed by conventional coating processes because at high coating speeds the curtain becomes unstable and this results in an inferior coated surface. Therefore, the conventional methods of producing multi-coated papers and paperboards employ the blade, rod or roll metering processes. Unfortunately, the. application of consecutive single layers of pigmented coatings to paper or paperboard at successive coating stations, whether by any of the above coating methods, remains a capital-intensive process due to the number of coating stations required, the amount of ancillary hardware required, for example, drive units, dryers, etc., and the space that is required to house the machinery.

The curtain coating method for the simultaneous coating of multiple layers is well known and is described in U.S. Pat. Nos. 3,508,947 and 3,632,374 for applying photographic compositions to paper and plastic web. However, photographic solutions or emulsions have a low viscosity and a low solids content, and are applied at low coating speeds.

In addition to photographic applications, the simultaneous application of multiple coatings by curtain coating methods is known from the art of making pressure sensitive copying paper. For example, U.S. Pat. No. 4,230,743 discloses in one embodiment the simultaneous application of a base coating comprising microcapsules as main component and a second layer comprising a color developer as a main component onto a travelling web. However, it is reported that the resulting paper has the same characteristics as the paper made by sequential application of the layers. Moreover, the coating composition containing the color developer is described as having a viscosity between 10 and 20 cps at 22° C.

JP-A-10-328613 discloses the simultaneous application of two coating layers onto a paper web by curtain coating to make an inkjet paper. The coating compositions applied according to the teaching of that reference are aqueous solutions with an extremely low solids content of 8% by weight. Furthermore a thickener is added in order to obtain non-Newtonian behavior of the coating solutions. The examples in JP-A-10-328613 reveal that acceptable coating quality is only achieved at line speeds below 400 m/min.

In view of the deficiencies of the prior art, it would be desirable to have an economical, improved process for preparing substrates, such as paper or paperboard, having barrier properties.

SUMMARY OF THE INVENTION

The technical problem underlying the present invention is the provision of a method of producing a coated substrate comprising barrier properties that overcomes the drawbacks of the prior art. Advantageously, the present invention allows one to apply multiple barrier layers to a substrate, whereby each barrier layer imparts a specific barrier functionality so that by selecting said specific layers a substrate having specific barrier properties can be designed.

The technical problem of the present invention is solved by a method of producing a coated substrate comprising the steps of:

a) forming a composite, multilayer free flowing curtain, whereby the multilayer free flowing curtain comprises at least two layers imparting at least two different barrier functionalities selected from the group consisting of oil and/or grease barrier functionality, water vapor barrier functionality, water resistance functionality, solvent barrier functionality, aroma barrier functionality, and oxygen barrier functionality and b) contacting the curtain with a continuous web substrate, whereby, in case an oil and/or grease barrier layer is present in the multilayer curtain the coated substrate has a Kit value of at least about 5 in the flat-test, in case a water vapor barrier layer is present in the multilayer curtain the coated substrate has a water vapor transmission rate of less than about 50 g/($m^2$/day) (50% relative humidity, 23° C.), in case a water resistance layer is present in the multilayer curtain the coated substrate has a 10 minute Cobb value of less than about 20 g/$m^2$, in case an oxygen barrier layer is present in the multilayer curtain the coated substrate has an oxygen transmission rate of less than about 200 $cm^3$/($m^2$/24 h/bar) (1 atm, 23° C., 90% relative humidity).

DETAILED DESCRIPTION OF THE INVENTION

Figure 1:
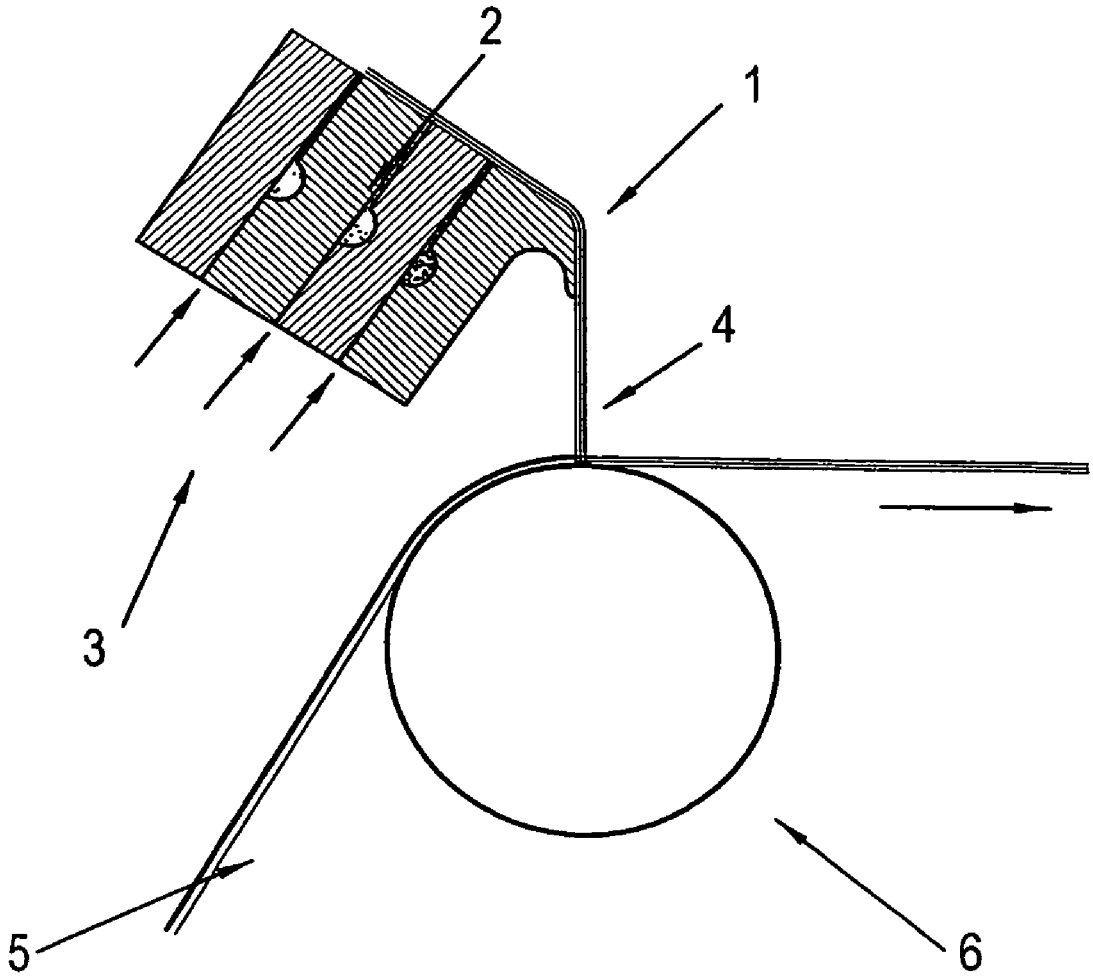
FIG. 1 is an explanatory cross-sectional view of a preferred curtain coating unit 1 with a slide nozzle arrangement 2 for delivering multiple streams 3 of curtain layer to form a continuous, multilayer curtain 4.

As used herein, the term "coated substrate" also encompasses coated basepaper or paperboard. The term "continuous web substrate" encompasses a continuous web substrate of basepaper and paperboard. Furthermore, as used herein, the term "barrier layer" is to be understood as a layer imparting at least one barrier functionality as defined above.

For the purposes of the present invention, when an organic solvent barrier functionality is present, the coating provides a barrier to organic solvents according to commercially acceptable standards. For the purposes of the present invention, when an aroma barrier functionality is present, the coating provides a barrier to aromas according to commercially acceptable standards.

The multilayer free flowing curtain of the invention has a bottom or interface layer, a top layer and optionally one or more internal layers. The coating curtain of the present invention includes at least two, preferably at least three, even more preferably at least four, even more preferably at least five, and most preferably at least six layers. The layers of the curtain can include one or more printing layers, one or more functional layers, one or more spacing layers, one or more coating layers, and layers imparting barrier functionalities, and the like, or any combination thereof. A spacing layer is a layer that separates at least two other layers. Each layer of the curtain comprises a liquid, emulsion, dispersion, suspension or solution. In a preferred embodiment, the free-flowing curtain of step a) comprises a top layer providing printability.

Preferably, the multilayer curtain of step a) comprises at least one layer comprising at least one pigment such as clay, kaolin, calcined clay, talc, calcium carbonate, titanium dioxide, satin white, synthetic magadiite, hollow or solid synthetic polymer pigment, zinc oxide, barium sulfate, gypsum, silica, alumina trihydrate, mica, and diatomaceous earth. Kaolin, talc, calcium carbonate, titanium dioxide, satin white and synthetic polymer pigment, including hollow polymer pigments, are particularly preferred. For enhanced barrier properties at least one layer may comprise certain platy type pigments such as, for example, talc, laminar nanoparticles, high aspect ratio clay, mica, synthetic magadiite and the like.

Furthermore, in the multilayer curtain of step a) at least one layer comprises a binder. Binders useful in the practice of the present invention include, for example, styrene-butadiene latex, styrene-acrylate latex, styrene-butadiene-acrylonitrile latex, styrene-acrylate-acrylonitrile latex, styrene-butadiene-acrylate-acrylonitrile latex, styrene-maleic anhydride latex, styrene-acrylate-maleic anhydride latex, polysaccharides, proteins, polyvinyl pyrrolidone, polyvinyl alcohol, polyvinyl acetate, cellulose and cellulose derivatives. Examples of preferred binders include carboxylated styrene-butadiene latex, carboxylated styrene-acrylate latex, carboxylated styrene-butadiene-acrylonitrile latex, carboxylated styrene-maleic anhydride latex, carboxylated polysaccharides, proteins, polyvinyl alcohol, carboxylated polyvinyl acetate latex and mixtures thereof. Examples of polysaccharides include agar, sodium alginate, and starch, including modified starches such as thermally modified starch, carboxymethylated starch, hydroxyelthylated starch, and oxidized starch. Examples of proteins that can be suitably employed in the process of the present invention include albumin, soy protein, and casein. A wide variety of suitable binders are commercially available. Mixtures of binders can be employed.

The coatweight of each layer of the curtain can be adjusted to obtain the desired coated substrate properties. Preferably, the dry coatweight of each layer is from about 0 to about 30 g/$m^2$. At least one of the layers of the multilayer curtain of step a) suitably has a dry coatweight of less than about 30 g/$m^2$, preferably less than about 20 g/$m^2$, more preferably less than about 10 g/$m^2$, even more preferably less than about 5 g/$m^2$, and most preferably less than about 3 g/$m^2$. An individual layer of the curtain can have a dry coatweight of 0 g/$m^2$ when it contains no solids.

The coating prepared from the multilayer curtain of step a) preferably has a dry coatweight on the paper produced of from about 3 to about 60 g/$m^2$, more preferably from about 5 to about 25 g/$m^2$. The coating prepared from the curtain desirably has a dry coatweight of less than about 60 g/$m^2$, alternatively less than about 30 g/$m^2$, alternatively less than about 20 g/$m^2$, alternatively less than about 15 g/$m^2$, alternatively less than about 12 g/$m^2$, alternatively less than about 10 g/$m^2$, and most preferably less than about 5 g/$m^2$. The viscosity and solids content of each barrier layer can vary widely depending on the desired function. Any combination of viscosity and solids content can be employed so long as suitable barrier properties are obtained. Each barrier layer present in the multilayer curtain of the present invention preferably has a solids content of up to about 75% by weight and a viscosity of up to about 3,000 cps (Brookfield, spindle 5,100 rpm, 25° C.) more preferably about 30 to about 2,000 cps. Preferably, the coatweight of a barrier layer is from about 0.1 to about 30 g/m$^2$, more preferably about 1 to about 10 g/m$^2$. Desirably, the viscosity of the barrier layer is at least about 50 cps, is preferably at least about 100 cps, is more preferably at least about 200 cps, and even more preferably is from about 230 cps to about 2000 cps.

The free-flowing curtain of step a) preferably has a solids content of at least about 10 wt. %, preferably at least about 40 wt. %, more preferably at least about 45 wt. %, and most preferably at least about 50 wt. %. The viscosity of the layers of the curtain is not critical so long as the layers form a free-flowing curtain. Preferably, the curtain has a solids content of from about 10 to about 75 wt. %.

The curtain of step a) of the invention can further include one or more non-barrier-functional layers. The purpose of the functional layer is to impart a desired functionality to the coated paper. Functional layers can be selected to provide, for example, printability, sheet stiffness, sheet flexibility, fold crack resistance, paper sizing properties, release properties, adhesive properties, heat seal properties, abrasion resistance properties and optical properties, such as, color, brightness, opacity, gloss, etc. Functional coatings that are very tacky in character would not normally be coated by conventional consecutive coating processes because of the tendency of the tacky coating material to adhere the substrate to guiding rolls or other coating equipment. The simultaneous multilayer method, on the other hand, allows such functional coatings to be placed underneath a topcoat that shields the functional coating from contact with the coating machinery.

Desirably, the barrier properties of the coated substrate are maintained even after the substrate is folded or bent. The fold crack resistance of the coated substrate can be determined according to a visual inspection of the folded substrate using a Heildelberg Quickfolder to crease the coated sample. The fold crack resistance of coated substrate of the present invention is preferably at least about 2. In one embodiment of the invention, a flexible functional layer and/or a flexible barrier layer is employed in order to increase the fold resistance of the coated substrate.

In a preferred embodiment the multilayer curtain of step a) comprises at least one layer imparting barrier functionalities comprising at least one or more components such as, for example, ethylene acrylic acid copolymers, ethylene vinyl alcohol copolymers, polyurethanes, epoxy resins, polyesters, polyolefins, carboxylated styrene butadiene latexes, carboxylated styrene acrylate latexes, polyvinylidiene chlorides, polyvinyl chlorides, starches, protein styrene-acrylic copolymers, styrene maleic anhydrides, polyvinyl alcohols, polyvinyl acetates, carboxymethyl celluloses, silicones, waxes, neoprenes, polyhydroxy ethers, lacquers, polylactic acids, copolymers of polylactic acid, polymers containing fluorine atoms, copolymers of acrylonitrile such as carboxylated styrene butadiene acrylonitrile copolymers, and mixtures thereof.

Preferably, in the composite multilayer free-flowing curtain of step a) the interface layer, which is the layer that comes in contact with the substrate to be coated, is not a barrier layer. One important function of the interface layer is to promote wetting of the substrate. The interface layer can have more than one function. For example, in addition to wetting, it may provide coverage of the substrate, and improved functional performance such as adhesion, sizing, stiffness or a combination of functions. This layer is preferably a relatively thin layer if it is not providing additional functionality. The coatweight of the interface layer suitably is from about 0.1 to about 30 g/m$^2$, and is preferably from about 1 to about 3 g/m$^2$. The solids content of the interface layer suitably is from about 0.1 to about 75%, based on the weight of the interface layer in the curtain. In one embodiment, the interface layer is relatively low in solids, preferably having a solids content of from about 0.1 to about 40%. Preferably, the viscosity of the interface layer is at least about 55 cps, is more preferably at least about 100 cps, and is even more preferably at least about 200 cps. Preferably the viscosity of the interface layer is from about 230 cps to about 2000 cps.

In a preferred embodiment, at least one layer of the multilayer free-flowing curtain of step a) comprises additives customary to a person skilled in the art, such as, for example, at least one surfactant, at least one dispersant, at least one lubricant, at least one water-retention agent, at least one crosslinking agent, at least one optical whitening agent, at least one pigment dye or colorant, at least one thickening agent, at least one defoamer, at least one antifoaming agent, at least one biocide or at least one soluble dye or colorant, or the like. Mixtures of additives can be employed.

Conventional coating formulations, referred to in the industry as coating colors, can be employed in the curtain. Preferably, the coating colors are deaerated prior to coating in order to remove air bubbles in the coating, which may cause coating defects.

The curtain layers can be simultaneously applied according to the present invention by using a curtain coating unit with a slide nozzle arrangement for delivering multiple liquid layers to form a continuous, multilayer curtain. Alternatively, an extrusion type supplying head, such as a slot die or nozzle, having several adjacent extrusion nozzles can be employed in the practice of the present invention.

The barrier properties of the obtained coated substrate can be determined by methods customary to a person skilled in the art.

Preferably, the coated substrate has a Kit value of at least about 5 in the flat-test and/or a Kit value of at least about 3 in the creased-test when an oil and/or grease barrier layer is present in the multilayer curtain. Preferably, in the case where an oil and/or grease barrier layer is present in the multilayer curtain, the coated substrate will pass the hot oil (oleic acid) stain resistance test, the details of which are specified herein below. In a preferred embodiment, when an oil and/or grease barrier layer is present in the multilayer curtain of step a) the coated paper or paper board has a Kit value of at least about 8 in the flat test, more preferably at least about 11 and most preferably at least about 12. Moreover, in case that an oil and/or grease barrier layer is present in the multilayer curtain of step a) the coated paper or paper board has a Kit value of at least about 4 in the creased Kit, more preferably at least about 7. Preferably, the flat Kit value of the coated substrate is from about 5 to about 12. Preferably, the creased Kit value of the coated substrate is from about 4 to about 12.

The coated substrate preferably has a water vapor transmission rate of less than about 40 g/(m$^2$ day) (50% relative humidity, 23° C.), more preferably less than about 30 g/(m$^2$ day) and most preferably less than about 10 g/(m$^2$ day). Preferably, the water vapor transmission rate of the coated substrate is from about 0 to about 40 g/(m$^2$/day).

Preferably, the coated substrate has a 10 minute Cobb value of less than about 12 g/m$^2$ when a water resistance layer is present in the multilayer curtain, more preferably less than about 6, even more preferably less than about 1.5 $g/m^2$, and most preferably less than about 0.5 $g/m^2$. Preferably, the 10 minute Cobb value of the coated substrate is from about 0 to about 12 $g/m^2$.

Preferably, the coated substrate has an oxygen transmission rate of less than about 150 $cm^3/(m^2/24\ h/bar)$ (1 atm, 23° C., 90% relative humidity) when an oxygen barrier layer is present in the multilayer curtain, more preferably less than about 100 $cm^3/(m^2/24\ h/bar)$, and even more preferably less than about 50 $cm^3/(m^2/24\ h/bar)$. Preferably, the coated substrate has an oxygen transmission rate of from about 0 to about 150 $cm^3/(m^2/24\ h/bar)$.

In one embodiment, the continuous web substrate of step b) is neither precoated nor precalendered. In another embodiment the continuous web substrate of step b) is not precoated, and in a further embodiment the continuous web substrate of step b) is not precalendered.

The continuous web substrate of step b) can have a web velocity that is suitable for preparing an acceptable coated substrate. The velocity preferably is at least about 200 m/min, more preferably at least about 400 m/min, even more preferably at least about 500 m/min, and most preferably at least about 800 m/min. Preferably, the velocity is from about 200 to about 2500 m/min. The continuous web substrate of step b) preferably has a grammage, or basis weight, of from about 30 to about 400 $g/m^2$.

FIG. 1 is an explanatory cross-sectional view of a preferred curtain coating unit 1 with a slide nozzle arrangement 2 for delivering multiple streams 3 of curtain layer to form a continuous, multilayer curtain 4. When a dynamic equilibrium state is reached, the flow amount of the curtain layers flowing into the slide nozzle arrangement 2 is completely balanced with the flow amount flowing out of the slide nozzle arrangement. The free falling multilayer curtain 4 comes into contact with web 5, which is running continuously, and thus the web 5 is coated with the multilayer curtain. The running direction of the web 5 is changed immediately before the coating area by means of a roller 6 to minimize the effect of air flow accompanying the fast moving web 5.

The advantage of the present invention over the prior art is that a coated barrier substrate having specific barrier properties can be obtained by combining specific functional layers within the multilayer curtain. Said technique makes it possible to apply several barrier layers to a substrate in one coating step. Furthermore, the applied barrier layers can be thinner than the barrier layers of the current state of the art. The method of the present invention also overcomes wetting or water repellency issues of coating color on a previously dry barrier layer, which a problem with multistep film press or blade coating. The coated substrates of the present invention are useful in flexible packaging foreign liquids and can also be used as an economical protection for fabricated products.

SPECIFIC EMBODIMENTS OF THE INVENTION

The present invention is exemplified by the following examples. All parts and percentages are by weight unless otherwise indicated.

TEST METHODS

Hot Oil Test

Hot oil (oleic acid) at 60° C. is placed on the sample for 1 hour at room temperature and the sample is visually inspected for staining. If there is a stain the result is a failure. Passing samples at room temperature are placed in an oven having a temperature of 60° C. for 24 hours, after which the oil is rubbed off and the sample is visually inspected for staining. If there is no stain the result is a pass, but if there is a stain present the result is a failure.

Moisture Vapor Transmission Rate (MVTR)

The water vapor barrier is measured using the Technical Association of the Pulp and Paper Industry (TAPPI) test T-448. This procedure describes the means to test moisture vapor transmission rate at a temperature of 23° C. and 50% relative humidity. The test result is expressed as a value in [$g/m^2/day$].

Cobb Test

The water resistance is measured as the resistance of the coating to the passage of puddled surface water. The test is the Cobb Size. The Cobb method measures the water absorptiveness of paper and is conducted in accordance to the test procedure defined by TAPPI T-441.

Kit Test

The 3M Kit Test is performed according to the test procedure defined by TAPPI T-559.

Oxygen Barrier

The oxygen barrier test is performed according to the test procedure defined by ASTM D1434.

Fold Cracking Resistance

The fold crack resistance of the coated substrate can determined according to a visual inspection of the folded substrate using a Heildelberg Quickfolder to crease the coated sample. Prior to folding, the samples are conditioned at 25° C. at 50% RH for 24 hours and then a black ink film is applied to enhance the contrast. After folding, the crease is visually inspected and rated on a scale of 1 to 5. A rating of 1 indicates no damage to the film in the crease. A rating of 2 indicates some damage but the film remains intact. A rating of 3 indicates the film is damaged to the point that some delaminating of the film from the substrate has occurred. A rating of 4 indicates the film has failed but there is no fiber damage. A rating of 5 indicates a failed film and fiber damage.

Brookfield Viscosity

The viscosity is measured using a Brookfield RVT viscometer (available from Brookfield Engineering Laboratories, Inc., Stoughton, Mass. USA). For viscosity determination, 600 ml of a sample are poured into a 1000 ml beaker and the viscosity is measured at 25° C. at a spindle speed of 20 and 100 rpm.

Coatweight

The coatweight achieved in each paper coating experiment is calculated from the known volumetric flow rate of the pump delivering the coating to the curtain coating head, the speed at which the continuous web of paper is moving under the curtain coating head, the density and percent solids of the curtain, and the width of the curtain.

Coating Density

The density of a curtain layer is determined by weighing a 100-millilitre sample of the coating in a pyknometer.

Paper Gloss

Paper gloss is measured using a Zehntner ZLR-1050 instrument at an incident angle of 75°.

Ink Gloss

The test is carried out on a Pruefbau Test Printing unit with Lorrilleux Red Ink No. 8588. An amount of 0.8 g/m$^2$ (or 1.6 g/m$^2$ respectively) of ink is applied to coated paper test strips mounted on a long rubber-backed platen with a steel printing disk. The pressure of the ink application is 1,000 N and the speed is 1 m/s. The printed strips are dried for 12 hours at 20° C. at 55% minimum room humidity. The gloss is then measured on a Zehntner ZLR-1050 instrument at an incident angle of 75°.

Ink Set Off

The test is carried out on a Pruefbau Test Printing unit. 250 mm$^3$ of ink (Huber No 520068) is distributed for 1 minute on the distributor. A metal printing disk is inked by being placed on the distributor for 15 seconds. The disk is placed on the first printing station. At the second printing station an uninked metal printing disk is placed, with a pressure of 400N. The coated paper strip, mounted on a rubber-backed platen, is printed with a printing pressure of 1000N at a speed of 1.5 m/s. Time 0 is taken when printing happens. After the strip is printed at the first station, move the strip towards second printing station, or set off station, by moving the hand lever. At the set off station, place a blank paper strip between the printed paper and the disk. At 15, 30, 60 and 120 seconds, the blank paper is pressed against the printed sample in the set off station by moving the hand lever. The amount of non-immobilized ink from the printed paper transferred to the blank paper is measured by ink densities as given by optical density measurements.

Brightness

Brightness is measured on a Zeiss Elrepho 2000. Brightness is measured according to ISO standard 2469 on a pile of sheets. The result is given as R457.

Dry Pick Resistance (IGT)

This test measures the ability of the paper surface to accept the transfer of ink without picking. The test is carried out on an A2 type printability tester, commercially available from IGT Reprotest BV. Coated paper strips (4 mm×22 mm) are printed with inked aluminum disks at a printing pressure of 36 N with the pendulum drive system and the high viscosity test oil (red) from Reprotest BV. After the printing is completed, the distance where the coating begins to show picking is marked under a stereomicroscope. The marked distance is then transferred into the IGT velocity curve and the velocities in cm/s are read from the corresponding drive curve. High velocities mean high resistance to dry pick.

Wet Pick

The test is carried out on a Pruefbau Test Printing unit equipped with a wetting chamber. 500 mm$^3$ of printing ink (Hueber 1, 2, 3 or 4, depending on overall wet pick resistance of the paper) is distributed for 2 min on the distributor; after each print re-inking with 60 mm$^3$ of ink. A vulcanized rubber printing disk is inked by being placed on the distributor for 15 sec. Then, 10 mm$^3$ of distilled water is applied in the wetting chamber and distributed over a rubber roll. A coated paper strip is mounted on a rubber-backed platen and is printed with a printing pressure of 600N and a printing speed of 1 m/s. A central strip of coated paper is wetted with a test stripe of water as it passes through the wetting chamber. Printing is done on the same test strip immediately after coming out of the wetting chamber. Off print of the printing disk is done on a second coated paper test strip fixed on a rubber-backed platen; the printing pressure is 400N. Ink densities on both test strips are measured and used in the following formulas:

Ink transfer, defined as $X=(B/A)*100\%$

Ink refusal, defined as $Y=((100\times D-X*C)/100*A)*100\%$, and

Wet pick, defined as $Z=100-X-Y\%$; where

A is the ink density on the non-wetted side stripes of the first coated test strip, B: is the ink density on the wetted central stripe of the first coated test strip, C: is the ink density on the side stripes for the off print done on the second strip, and D: is the ink density on the central stripe for the off print done on the second strip.

Paper Roughness

The roughness of the coated paper surface is measured with a Parker PrintSurf roughness tester. A sample sheet of coated paper is clamped between a cork-melinex platen and a measuring head at a clamping pressure of 1,000 kPa. Compressed air is supplied to the instrument at 400 kPa and the leakage of air between the measuring head and the coated paper surface is measured. A higher number indicates a higher degree of roughness of the coated paper surface.

Solvent Resistance

The solvent resistance of a barrier layer is its ability to withstand solvent attack with minimal change in appearance, dimensions, mechanical properties, and weight over a period of time. Test conditions include the length of exposure, concentration, temperature, and internal stress. Solvent resistance of multilayer barrier substrates can be evaluated using ASTM D543. The final classification as solvent resistant depends on the application.

Aroma Barrier

A barrier that retards loss of aroma is a material that inhibits permeation of the aroma through the barrier layer. Permeability is determined by measurement of aroma transmission through specimens under controlled conditions of temperature and driving force. Numerous analytical techniques, depending on the nature of the aroma compound, can be used to detect permeation. Permeation results are reported in units of mass over path length, time and pressure difference.

Formulations

The following materials were used in the coating liquids:

Carbonate: dispersion of calcium carbonate with particle size of 90%<2 μm in water (HYDROCARB 90 ME available from Omya AG, Oftringen, Switzerland), 77% solids.

Clay: dispersion of No. 1 high brightness kaolin clay with particle size of 98%<2 μm in water (HYDRAGLOSS 90 available from J.M Huber Corp., Have de Grace, Maryland, USA), 71% solids.

Latex (A): carboxylated styrene-butadiene latex (DL 966 available from The Dow Chemical Company), 50% solids in water.

Latex (B): carboxylated styrene-butadiene latex (DL 980 available from The Dow Chemical Company), 50% solids in water.

PVOH: solution of 15% of low molecular weight synthetic polyvinyl alcohol (MOWIOL 6/98 available from Clariant AG, Basel Switzerland)

Surfactant: aqueous solution of sodium di-alkylsulphosuccinate (AEROSOL OT available from Cyanamid, Wayne, N.J., USA), 75% solids.

PE Dispersion (A): anionic dispersion of ethylene acrylic acid copolymer in water with minimum film formation temperature of 26° C. and Tg of 4° C. (TECHSEAL E-799/35, available from Trueb Chemie, Ramsen, Switzerland), 35% solids.

PE Dispersion (B): ethylene vinyl alcohol copolymer in water (EXCEVAL AQ 4005, available from EVAL Europe, Zwijndrecht, Belgium, this product is delivered as a dry powder and a solution is made at coater), 15% solids in water Whitener: fluorescent whitening agent derived from diamino-stilbenedisulfonic acid (TINOPAL ABP/Z, available from Ciba Specialty Chemicals Inc., Basel, Switzerland).

Coating procedure

The formulations were coated onto paper moving at 500 m/min according to the following procedure. A multilayer slide die type curtain coater manufactured by Troller Schweizer Engineering (TSE, Murgenthal, Switzerland) was used. The curtain coating apparatus was equipped with edge guides lubricated with a trickle of water and with a vacuum suction device to remove this edge lubrication water at the bottom of the edge guide just above the coated paper edge. In addition, the curtain coater was equipped with a vacuum suction device to remove interface surface air from the paper substrate upstream from the curtain impingement zone. The height of the curtain was 300 mm. Coating formulations were deaerated prior to use to remove air bubbles.

EXAMPLE 1

The above ingredients are mixed in the amounts and applied at the coatweights given in Table 1.

TABLE 1

| | Slot 1 | Slot 2 | Slot 3 | Slot 4 | Slot 5 |
|---|---|---|---|---|---|
| Carbonate | 70 | | 70 | | 70 |
| Clay | 30 | | 30 | | 30 |
| Latex (A) | | | | | 11 |
| Latex (B) | 50 | | 50 | | |
| PVOH | 1 | | 1 | | 2.5 |
| PE Dispersion (B) | | | | 100 | |
| PE Dispersion (A) | | 100 | | | |
| Surfactant | 0.4 | 0.2 | 0.4 | 0.4 | 0.2 |
| Whitener | | | | | 1 |
| Density (g/cc) | 1.34 | 0.98 | 1.34 | 1.03 | 1.57 |
| Viscosity (100 rpm Brookfield)(mPa · s) | 430 | 320 | 430 | 300 | 1040 |
| Coatweight (g/m$^2$) | 6 | 2 | 2.5 | 2.5 | 4.5 |
| pH | 8.5 | 8.2 | 8.5 | 9.1 | 8.5 |
| Solids (%) | 59.9 | 34.7 | 59.9 | 16 | 65.1 |

The pH of the pigmented coatings formulations is adjusted by adding NaOH solution (10%) to a value as indicated in Table 1. Water is added as needed to adjust the solids content of the formulations.

A pigmented layer (slot 1) is placed next to the paper. This formulation contains a high amount of a low Tg latex to ensure good fold cracking resistance for the barrier paper and a water soluble polymer to form the interface layer. The next layer (slot 2) contains an ethylene acrylic acid dispersion to form a water and water vapor barrier layer. The next layer (slot 3) contains a pigmented layer with a high amount of a low Tg latex to ensure good fold cracking resistance for the barrier paper. The next layer (slot 4) contains a water soluble ethylene vinyl alcohol copolymer to provide good grease and oil resistance. The top layer (slot 5) is a pigment layer with an optical brightening agent in the formulation to form a good printing surface.

EXAMPLE 2

The method of Example 1 is repeated except that the intermediate coating layer (Slot 3 of Table 1) is removed and the coatweights of the barrier coating layers as well as the top printing layer are adjusted as shown in Table 2.

TABLE 2

| | Slot 1 | Slot 2 | Slot 3 | Slot 4 |
|---|---|---|---|---|
| Carbonate | 70 | | | 70 |
| Clay | 30 | | | 30 |
| Latex (A) | | | | 11 |
| Latex (B) | 50 | | | |
| PVOH | 1 | | | 2.5 |
| PE Dispersion (B) | | | 100 | |
| PE Dispersion (A) | | 100 | | |
| Surfactant | 0.4 | 0.2 | 0.4 | 0.2 |
| Whitener | | | | 1 |
| Density (g/cc) | 1.34 | 0.98 | 1.03 | 1.57 |
| Viscosity (100 rpm Brookfield) (mPa · s) | 430 | 320 | 300 | 1040 |
| Coatweight (g/m$^2$) | 6 | 3 | 1.5 | 6 |
| pH | 8.5 | 8.2 | 9.1 | 8.5 |
| Solids (%) | 59.9 | 34.7 | 16 | 65.1 |

EXAMPLE 3

The method of Example 2 is repeated except that the coatweight of Slot 1 is decreased to 2 g/m$^2$ and the coatweights of the barrier layers Slot 2 and Slot 3 are increased to 5 and 2.5 g/m$^2$ respectively.

Table 3 contains the Cobb, MVTR, Kit and Hot Oil properties for Examples 1-3.

TABLE 3

| | Cobb 10 minutes (g/m$^2$) | Water vapor transmission rate (g/m$^2$/24 h) T = 23° C., RH = 50%/ T = 38° C., RH = 90% | Kit Flat/creased | Hot Oil |
|---|---|---|---|---|
| Example 1 | 8.9 | 9.12/162 | 7/fail | pass |
| Example 2 | 10.3 | n.m./119 | 5/n.m. | pass |
| Example 3 | 11.1 | n.m./94 | 12/3 | pass |

n.m. = not measured

The results in Table 3 show that it is possible to have a combination of improved water and oil/grease barrier properties from the multilayer curtain.

Table 4 summarizes the coated paper properties for Examples 1-3.

TABLE 4

| Coated Paper Properties | Example 1 | Example 2 | Example 3 |
|---|---|---|---|
| PAPER GLOSS 75° | 63 | 62 | 66 |
| INK GLOSS 75°; 0.8 g/m$^2$ INK | 85 | 77 | 88 |
| INK GLOSS 75°; 1.6 g/m$^2$ INK | 91 | 88 | 93 |
| SMOOTHNESS PPS H 1000 | 1.3 | 1.3 | 1.0 |
| ISO BRIGHTNESS R 457 | 92.5 | 93.7 | 93.7 |
| IGT DRY PICK | >110 | >110 | >110 |
| WET PICK: INK TRANSFER | 2 | 24 | 23 |
| WET PICK: INK REFUSAL | 98 | 70 | 75 |

TABLE 4-continued

| Coated Paper Properties | Example 1 | Example 2 | Example 3 |
|---|---|---|---|
| WET PICK: WET PICK | 0 | 6 | 2 |
| INK SET OFF AFTER 15 SEC. | 1.22 | 1.09 | 1.13 |
| INK SET OFF AFTER 30 SEC. | 1.14 | 0.92 | 1.10 |
| INK SET OFF AFTER 60 SEC. | 1.10 | 0.72 | 0.93 |
| INK SET OFF AFTER 120 SEC. | 1.07 | 0.64 | 0.89 |

The results in Table 4 show that the multilayer curtain with barrier layers and a top printing layer gave acceptable coated paper properties compared to current commercial papers.

What is claimed is:

1. A method of producing a coated basepaper or paperboard substrate comprising the steps of:

a) forming a composite, multilayer free flowing curtain, wherein at least one of the layers of the curtain has a coatweight when dried of less than about 30 g/m$^2$, the curtain has a solids content of at least about 40 wt. %, and wherein the curtain has an interface layer, and the interface layer of the curtain has a viscosity of at least about 430 centipoise, whereby the multilayer free flowing curtain comprises at least two layers imparting at least two different barrier functionalities selected from the group consisting of oil and/or grease barrier functionality, water vapor barrier functionality, water resistance functionality, and oxygen barrier functionality, and wherein the free flowing curtain comprises an additional top layer providing printability;

b) contacting the curtain with a continuous basepaper or paperboard web substrate having a velocity of at least about 200 m/min., whereby, in case an oil and/or grease barrier layer is present in the multilayer curtain the coated substrate has a Kit value of at least about 5 in the flat-test, in case a water vapor barrier layer is present in the multilayer curtain the coated substrate has a water vapor transmission rate of less than about 50 g/(m$^2$/day) (50% relative humidity, 23° C.), in case a water resistance layer is present in the multilayer curtain the coated substrate has a 10 minute Cobb value of less than about 20 g/m$^2$, in case an oxygen barrier layer is present in the multilayer curtain the coated substrate has an oxygen transmission rate of less than about 200 cm$^3$/(m$^2$d/bar) (1 atm, 23° C., 90% relative humidity).

2. The method of claim 1 wherein at least one oil and/or grease barrier layer is present in step a), and the coated substrate has a Kit value of at least about 8 in the flat-test.

3. The method of claim 1 wherein at least one water vapor barrier layer is present in step a), and the coated substrate has a water vapor transmission rate of less than about 40 g/(m$^2$/day) (50% relative humidity, 23° C.).

4. The method of claim 1 wherein at least one water resistance barrier layer is present in step a), and the coated substrate has a 10 minute Cobb value of less than about 12 g/m$^2$.

5. The method of claim 1 wherein at least one oxygen barrier layer is present in step a), and the coated substrate has an oxygen transmission rate of less than about 150 cm$^3$/(m$^2$/24 h/bar) (1 atm, 23° C., 90% relative humidity).

6. The method of claim 1, wherein the curtain is formed with a slot die.

7. The method of claim 1, characterized in that the multilayer curtain of step a) comprises at least an additional layer providing fold crack resistance.

8. The method of claim 1, characterized in that at least one of the layers of the multilayer curtain of step a) has a coatweight when dried of less than about 20 g/m$^2$.

9. The method of claim 1, characterized in that at least one of the layers of the multilayer curtain of step a) has a coatweight when dried of less than about 10 g/m$^2$.

10. The method of claim 1, characterized in that the multilayer curtain of step a) has a coatweight when dried of less than about 60 g/m$^2$.

11. The method of claim 1, characterized in that the multilayer curtain of step a) has a coatweight when dried of less than about 30 g/m$^2$.

12. The method of claim 1, characterized in that the multilayer curtain of step a) comprises at least 3 layers.

13. The method of claim 1, characterized in that the multilayer curtain of step a) comprises at least 4 layers.

14. The method of claim 1, characterized in that the multilayer curtain of step a) comprises at least 5 layers.

15. The method of claim 1, characterized in that the multilayer curtain of step a) comprises at least 6 layers.

16. The method of claim 1, characterized in that the multilayer curtain of step a) comprises at least one layer comprising at least one pigment.

17. The method of claim 16, characterized in that the pigment is selected from the group consisting of clay, kaolin, calcined clay, talc, calcium carbonate, laminar nanoparticles, high aspect ratio clays, titanium dioxide, satin white, synthetic polymer pigment, zinc oxide, barium sulfate, gypsum, silica, alumina trihydrate, mica, and diatomaceous earth.

18. The method of claim 1, characterized in that at least one layer imparting barrier functionality of the multilayer curtain of step a) comprises at least one or more components selected from the group consisting of ethylene acrylic acid copolymers, ethylene vinyl alcohol copolymers, polyurethanes, epoxy resins, polyesters, polyolefins, carboxylated styrene butadiene latexes, carboxylated styrene acrylate latexes, polyvinylidiene chlorides, polyvinyl chlorides, starches, proteins, styrene-aciylic copolymers, styrene maleic anhydrides, polyvinyl alcohols, polyvinyl acetates, carboxymethyl celluloses, silicones, waxes, neoprenes, polyhydroxy ethers, lacquers, polylactic acids, copolymers of polylactic acid, polymers containing fluorine atoms, copolymers of acrylonkrile, carboxylated styrene butadiene acrylonitrile copolymers, and mixtures thereof.

19. The method of claim 1, characterized in that at least one layer imparting barrier functionality of the multilayer curtain of step a) comprises at least one or more components selected from the group consisting of polyvinyl chlorides, neoprenes, polyhydroxy ethers, lacquers, polylactic acids, copolymers of polylactic acid, polymers containing fluorine atoms, copolymers of acrylonitrile, carboxylated styrene butadiene acrylonitrile copolymers, and mixtures thereof.

20. The method of claim 1, characterized in that at least one layer of the multilayer free flowing curtain of step a) comprises at least one surfactant.

21. The method of claim 1, characterized in that the multilayer free flowing curtain of step a) has a solids content of at least about 45 wt. %.

22. The method of claim 1, characterized in that the continuous web substrate of step b) is neither precoated nor precalendered.

23. The method of claim 1, characterized in that the continuous web substrate of step b) has a web velocity of at least about 400 m/mim.

24. The method of claim 1, characterized in that the continuous web substrate of step b) has a web velocity of at least about 500 m/mim.

25. The method of claim 1, characterized in that the continuous web substrate of step b) has a grammage, or basis weight, of from about 30 to 400 $g/m^2$.

26. The method of claim 1, characterized in that the multilayer curtain of step a) comprises at least an additional layer providing at least one of the following: sheet stiffness; sheet flexibility; release properties; adhesive properties; friction control; heat seal properties; and abrasion resistance properties.

27. The method of claim 1, wherein the curtain is formed with a slide die.

28. The method of claim 1, wherein at least one layer of the curtain comprises polyethylene oxide.

29. The method of claim 1 wherein the interface layer comprises polyethylene oxide.

30. The method of claim 16, characterized in that the pigment comprises synthetic magadiite.

* * * * *